United States Patent [19]

Quartino

[11] Patent Number: 4,542,731

[45] Date of Patent: Sep. 24, 1985

[54] BOW WITH VERTICALLY AND HORIZONTALLY ADJUSTABLE ARROW SUPPORT

[75] Inventor: Miguel A. Quartino, St. Louis, Mo.

[73] Assignee: Hoyt/Easton, Bridgeton, Mo.

[21] Appl. No.: 481,932

[22] Filed: Apr. 4, 1983

[51] Int. Cl.[4] ..... F41B 5/00

[52] U.S. Cl. ..... 124/24 R; 124/41 A

[58] Field of Search ..... 124/41 A, 24 R, 88, 124/86, 35 A

[56] References Cited

U.S. PATENT DOCUMENTS

| | | | |
|---|---|---|---|
| 3,482,563 | 12/1969 | Pint | 124/24 R |
| 3,865,095 | 2/1975 | Helmick | 124/24 R |
| 4,170,980 | 10/1979 | Killian | 124/41 A |
| 4,299,195 | 11/1981 | Norris | 124/41 A X |
| 4,347,829 | 9/1982 | Okupniak | 124/41 A |

*Primary Examiner*—Richard J. Apley
*Assistant Examiner*—William R. Browne
*Attorney, Agent, or Firm*—Charles E. Markham

[57] ABSTRACT

A hollow cylindrical, internally and externally screw threaded support member extends through a vertically elongated aperture from side to side through the bow handle and is vertically adjustable therein. The support member has a square head on one end which is vertically slidable in a larger vertically elongated rectangular recess in one side of the bow handle, a nut on the other end thereof when tightened clamps the support member in a vertically adjusted position, an arrow rest is attached to the outer surface of the square head, and a hollow cylindrical, externally screw threaded member carrying a spring pressed arrow spacing plunger slidable longitudinally therein is threadedly engaged in said support member for horizontal adjustment.

3 Claims, 15 Drawing Figures

BOW WITH VERTICALLY AND HORIZONTALLY ADJUSTABLE ARROW SUPPORT

This invention relates generally to arrow rests and spacers for a bow and particularly concerns means for the vertical adjustment thereof.

Variations in the manner in which different archers grip a bow, anchor the nock end of the arrow and bow string when drawn and release the bow string and arrow frequently requires adjustment of the arrow rest supporting the fore end of the arrow in order to achieve dynamic stability of the bow and consistancy of arrow flight. It has been found that the vertical position of the arrow rest relative to the center of reactive force applied at the grip is critical in achieving consistancy of arrow flight and resulting tight target groups.

OBJECTS OF THE INVENTION

An object of the invention is to provide a vertically adjustable arrow rest for a bow;

A further object is to provide an arrow rest and an arrow spacer carried by a vertically adjustable support member A further object is to provide a vertically adjustable support member having an arrow rest fixed thereon and an arrow spacer mounted for horizontal adjustment thereon.

A still further object is to provide a vertically adjustable support member extending from side to side through a vertically elongated aperture in a bow handle having an arrow rest at one end thereof and an arrow spacer mounted thereon for horizontal adjustment.

Further objects and advantages will appear when reading the following description in connection with the accompanying drawings.

IN THE DRAWINGS

DESCRIPTION OF A PREFERRED FORM OF THE INVENTION

Figures 1, 2, 3, 4, 5, 6, 7, 8, 9, 10, 11, 12, 13, 14, 15:
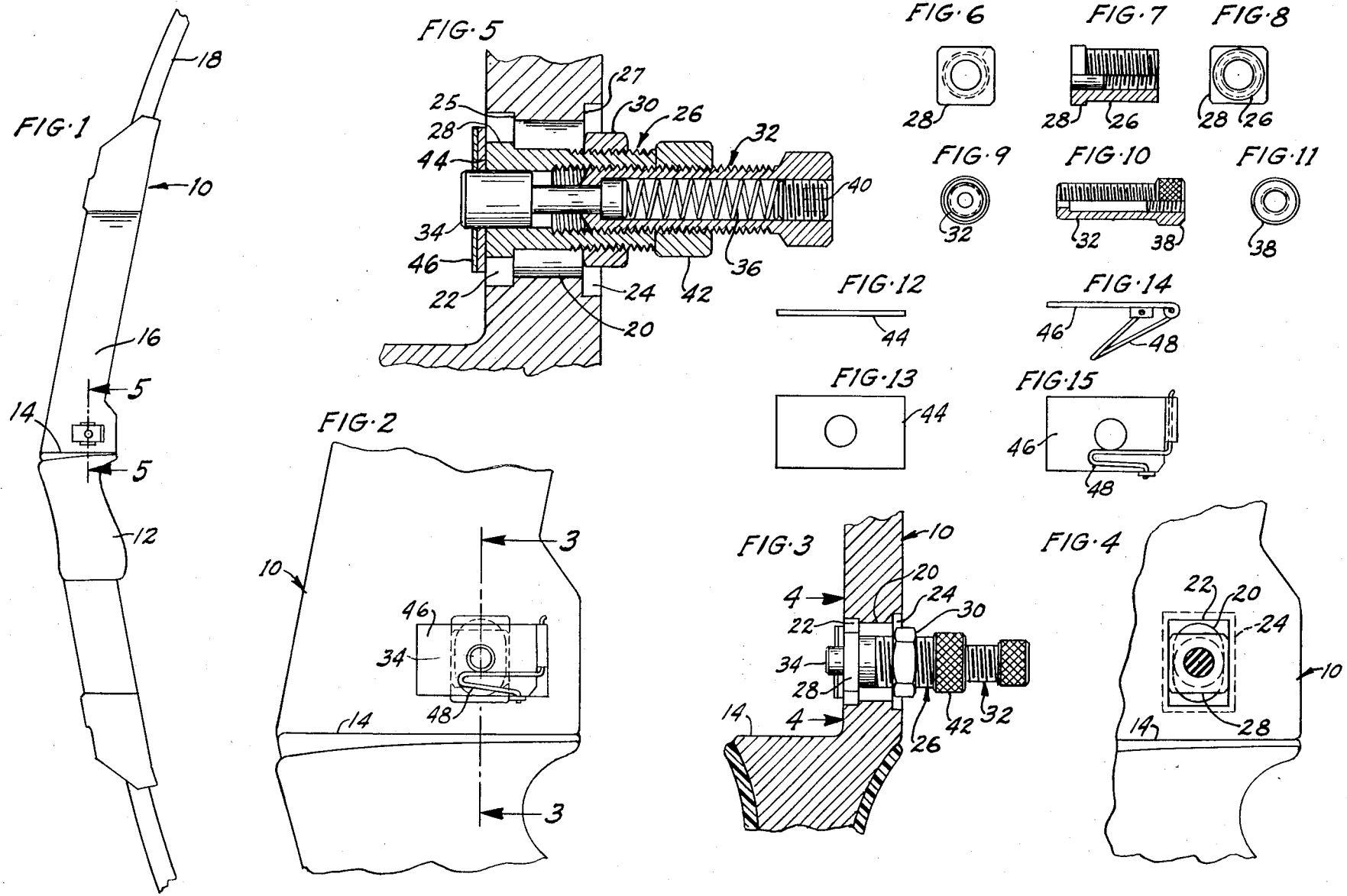
FIG. 1 is an arrow side elevational view of a bow handle section incorporating a vertically adjustable arrow rest and arrow spacer constructed in accordance with the present invention.
FIG. 2 is an enlarged fragmentary central portion of the bow handle section shown as in FIG. 1 with the arrow rest and arrow spacer device mounted thereon.
FIG. 3 is a cross sectional view taken along line 3—3 of FIG. 2 showing the vertically elongated aperture and recesses in the bow handle section and a side elevational view of the adjustable arrow rest and spacer mounted therein.
FIG. 4 is an arrow side elevational view with the arrow rest removed showing the vertically adjustable support member in the vertically elongated aperture and vertically elongated rectangular recess and is taken along line 4—4 of FIG. 3.
FIG. 5 is an enlarged cross sectional view taken along line 5—5 of FIG. 1.
FIGS. 6, 7 and 8 are front end, half sectionalized side and rear elevational views of the support member shown alone.
FIGS. 9, 10 and 11 are small end, half sectionalized side and head end elevational views of the hollow arrow spacer support screw shown alone.
FIGS. 12 and 13 are top edge and side elevational views of the adapter plate shown alone.
FIGS. 14 and 15 are top edge and side elevational views of the arrow rest shown alone.

The bow handle section shown in FIG. 1 and generally indicated at 10 has a grip portion 12, a ledge 14 and a sight window 16 on the arrow side thereof. Attached to the ends of the handle section 10 are bow limbs 18 shown fragmentarily. There is a vertically elongated aperture 20 extending through the bow handle section from the arrow side to the opposite side. The aperture 20 is positioned above and adjacent the ledge 14 and has parallel vertical sides and rounded ends. There is a vertically elongated rectangular recess 22 in the arrow side of the handle section and a vertically elongated recess 24 in the opposite side of the handle section, see FIG. 4. The centers of the aperture 20 and the centers of rectangular recesses 22 and 24 are coaxial and the rectangular recesses 22 and 24 are larger than the aperture 20 and the sides and ends thereof extend beyond the sides and ends of aperture 20 thereby providing peripheral shoulders 25 and 27 around the aperture at both ends thereof.

An internally and externally screw threaded hollow cylindrical support member 26 extends through aperture 20 and is slidably movable vertically therein. Support member 26 has a square head 28 on one end thereof slidably fitted between the vertical sides of rectangular recess 22 and having a thickness substantially equal to the depth of recess 22. A nut 30 threadedly engaged on the other end of support member 26 enters the recess 24 and when tightened fixes support member 26 in a vertically adjusted position.

Threadedly engaged in the support member 26 and entered from the side opposite the arrow side is an externally screw threaded hollow cylindrical member 32. Member 32 carries longitudinally slidable therein the enlarged diameter inner end portion of an arrow spacing plunger 34. A spring 36 in hollow member 32 biases the plunger portion longitudinally outward against a shoulder formed at the end of hollow member 32. The plunger 34 also has an enlarged diameter outer end portion slidably guided in a smooth bore portion at the head end of support member 26 and projects from the surface of square head 28 an amount which may be varied by turning the screw threaded member 32. The member 32 has a knurled head 38 at it's outer end and has a short internally threaded portion near it's outer end to receive a screw 40 to retain the spring 36 therein. A jamb nut 42 threadedly engaged on member 32 is tightened against the end of support member 26 thereby to lock the horizontal adjustment of the arrow spacing plunger 34.

Attached to the outer surface of the square head 28 of support member 26 by any suitable means such as pinning, soldering or welding is a rectangular adapter plate 44 of larger area than square head 28 and lying against the outer surface of said adapter plate is an arrow support rest plate 46 of similar dimensions. The arrow rest support plate 46 supports a hinged wire loop type arrow rest 48. The adapter plate 44 and arrow rest support plate 46 are centrally perforated to permit the passage of arrow spacing plunger 34 therethrough. The arrow rest support plate 46 may be attached to the adapter plate 44 by any suitable means such as adhesive.

It will be understood that variations and modifications within the spirit of the invention will occur to those skilled in this art such as making the vertically elongated aperture 20 and the recesses 20 and 24 of the same shape. Also the arrow rest 48 may be of any suitable type. The foregoing description is intended to be illustrative and not limiting, the scope of the invention being set forth in the appended claims.

I claim:

1. In an archery bow, a handle section, a vertically elongated aperture extending horizontally through said handle section from side to side, an elongated hollow arrow rest support member extending through said aperture, said support member being movable vertically in said aperture and said aperture and said support member having contiguous vertical and opposite side surfaces thereon for guiding said support member vertically in said aperture, an enlarged head portion at one end of said elongated support member and an externally screw threaded portion at the other end thereof, a nut on said screw threaded portion which when tightened causes said enlarged head portion to bear against one side of said handle section and said nut to bear against the opposite side thereof to clamp said support member in a vertically adjusted position, an arrow rest mounted on the outer surface of said enlarged head portion, and an elongated, spring biased adjustable arrow spacing member mounted for longitudinal adjustment in said elongated hollow arrow rest support member so as to vary the protrusion of said member from the outer surface of said enlarged head portion.

2. The archery bow claimed in claim 1 which includes a vertically elongated recess formed in one side of said handle section at one end of said aperture, in which said enlarged head portion of said support member is inserted into said recess and is movable vertically therein and in which said contiguous vertical side surfaces are formed on the sides of said enlarged head and on the side walls of said recess.

3. The archery bow claimed in claim 1 in which said elongated hollow arrow rest support member is an elongated externally and internally screw threaded hollow cylinder, in which a second externally screw threaded hollow cylindrical arrow spacing support member is screw threadedly adjustable longitudinally in said arrow rest member, and in which said elongated arrow spacing member is slidable longitudinally in said arrow spacing support member and spring biased so as to project outward from one end thereof.

* * * * *